US009151297B2

(12) United States Patent
Zheng et al.

(10) Patent No.: US 9,151,297 B2
(45) Date of Patent: Oct. 6, 2015

(54) CENTRIFUGAL COMPRESSOR HAVING AN ASYMMETRIC SELF-RECIRCULATING CASING TREATMENT

(75) Inventors: Xinqian Zheng, Beijing (CN); Yun Lin, Beijing (CN); Yangjun Zhang, Beijing (CN); Mingyang Yang, Beijing (CN); Takahiro Bamba, Tokyo (JP); Hideaki Tamaki, Tokyo (JP)

(73) Assignees: IHI Corporation, Tokyo (JP); Tsinghua University, Beijing (CN)

( * ) Notice: Subject to any disclaimer, the term of this patent is extended or adjusted under 35 U.S.C. 154(b) by 524 days.

(21) Appl. No.: 13/578,101

(22) PCT Filed: Feb. 3, 2011

(86) PCT No.: PCT/JP2011/052269

§ 371 (c)(1),
(2), (4) Date: Aug. 9, 2012

(87) PCT Pub. No.: WO2011/099416

PCT Pub. Date: Aug. 18, 2011

(65) Prior Publication Data

US 2012/0308371 A1 Dec. 6, 2012

(30) Foreign Application Priority Data

Feb. 9, 2010 (CN) ..... 2010 1 0110230
Feb. 9, 2010 (CN) ..... 2010 1 0110273

(51) Int. Cl.
*F04D 29/42* (2006.01)
*F04D 29/68* (2006.01)

(52) U.S. Cl.
CPC ..... *F04D 29/4213* (2013.01); *F04D 29/685* (2013.01)

(58) Field of Classification Search
USPC ..... 415/58.4, 58.6, 203, 206, 58.3, 914
See application file for complete search history.

(56) References Cited

U.S. PATENT DOCUMENTS 4,930,979 A * 6/1990 Fisher et al. ..... 415/58.4
4,990,053 A * 2/1991 Rohne ..... 415/58.4
5,333,990 A * 8/1994 Foerster et al. ..... 415/58.4
6,290,458 B1 9/2001 Irie et al.

(Continued)

FOREIGN PATENT DOCUMENTS

JP 02-042199 2/1990
JP 3001902 B2 1/2000

(Continued)

OTHER PUBLICATIONS

International Search Report issued in corresponding application PCT/JP2011/052269, completed Apr. 18, 2011 and mailed Apr. 26, 2011.

(Continued)

*Primary Examiner* — Dwayne J White
*Assistant Examiner* — Joshua R Beebe
(74) *Attorney, Agent, or Firm* — Griffin & Szipl, P.C.

(57) ABSTRACT

A centrifugal compressor includes an asymmetric self-recirculating casing treatment that includes, on an inner face of a casing 10, a suction ring groove 1, a ring guide channel 2 and a back-flow ring groove 3 to form a self-recirculating channel. A position or a width of the suction ring groove 1 is distributed in an arc shape in a circumferential direction, and the arc has a center angle $\alpha$ in a range of $0<\alpha\leq 30°$.

6 Claims, 13 Drawing Sheets

(56) References Cited

U.S. PATENT DOCUMENTS

| | | | | |
|---|---|---|---|---|
| 7,229,243 | B2 | 6/2007 | Nikpour et al. | |
| 7,364,404 | B2 | 4/2008 | Guemmer | |
| 7,645,121 | B2 * | 1/2010 | Tudor | 415/220 |
| 2005/0008484 | A1 | 1/2005 | Nikpour et al. | |
| 2008/0044273 | A1 * | 2/2008 | Khalid | 415/57.4 |
| 2008/0199306 | A1 | 8/2008 | Lebret | |
| 2009/0290974 | A1 * | 11/2009 | Bayere et al. | 415/58.5 |
| 2010/0014956 | A1 * | 1/2010 | Guemmer | 415/9 |
| 2015/0056062 | A1 | 2/2015 | Tamaki | |

FOREIGN PATENT DOCUMENTS

| | | | |
|---|---|---|---|
| JP | 2001-263296 | A | 9/2001 |
| JP | 2003-106299 | | 4/2003 |
| JP | 2004-332734 | A | 11/2004 |
| JP | 2007-127109 | A | 5/2007 |
| JP | 2007-224789 | A | 9/2007 |
| JP | 4100030 | B2 | 6/2008 |
| JP | 4107823 | B2 | 6/2008 |

OTHER PUBLICATIONS

Office Action issued in co-pending related U.S. Appl. No. 13/578,163, filed on Feb. 23, 2015.

Office Action issued in co-pending related U.S. Appl. No. 13/578,188, filed on Feb. 25, 2015.

Office Action issued in co-pending related U.S. Appl. No. 13/578,137, filed on Mar. 4, 2015.

Final Office Action issued in co-pending related U.S. Appl. No. 13/578,188 on Jun. 18, 2015.

Office Action issued in co-pending related U.S. Appl. No. 13/578,163 on Jun. 19, 2015.

* cited by examiner

CENTRIFUGAL COMPRESSOR HAVING AN ASYMMETRIC SELF-RECIRCULATING CASING TREATMENT

This is a National Phase Application in the United States of International Patent Application No. PCT/JP2011/052269 filed Feb. 3, 2011, which claims priority on Chinese Patent Application No. 201010110230.5 filed Feb. 9, 2010 and Chinese Patent Application No. 201010110273.3 filed Feb. 9, 2010. The entire disclosures of the above patent applications are hereby incorporated by reference.

TECHNICAL FIELD

The present invention relates to centrifugal compressors including an asymmetric self-recirculating casing treatment. The centrifugal compressors are used in turbomachinery for various purposes such as superchargers for vehicles and ships, industrial compressors and aeroengines.

BACKGROUND ART

Although turbo compressors using a centrifugal compressor have advantages such as having better efficiency, being lighter in weight and having more stable in operation than reciprocating compressors, their allowable operating range (i.e., the flow rate range of a centrifugal compressor) is limited.

At a small flow-rate operating point of a centrifugal compressor (i.e., when the flow rate of a compressor is small), instable phenomena such as considerable fluid separation at the internal flow field occur, thus causing stall and accordingly surge. As a result, rapid decrease in the efficiency and the pressure-ratio of the compressor is caused, the life of the compressor is shortened, and accordingly the compressor is damaged in a short time. To cope with this, various countermeasures are taken to suppress instable phenomena such as stall of a compressor for an extended stable operating range.

For instance, for an extended stable operating range, a casing treatment for centrifugal compressor is used. The following Patent Documents 1 to 5 disclose a casing treatment, for example.

As a casing treatment in Patent Literatures 1 to 5, at an inner face of a casing surrounding an impeller of a centrifugal compressor are formed (or defined) an annular inlet that is downstream of a leading edge of the impeller and an annular outlet that is upstream of the leading edge of the impeller. With this configuration, when the inflow rate into the centrifugal compressor is small, the fluid is returned from the annular inlet to the annular outlet via a casing interior, whereby the apparent inflow rate into the impeller is increased. As a result, instable phenomena such as stall can be suppressed to extend a stable operating range of a centrifugal compressor.

CITATION LIST

Patent Literature

PTL 1: JP 3001902
PTL 2: JP-A-2007-127109
PTL 3: JP 4100030
PTL 4: JP 4107823
PTL 5: U.S. Pat. No. 4,930,979

SUMMARY OF INVENTION

As described above, a casing treatment is currently considered as effective means to extend a stable operating range of a centrifugal compressor.

Conventionally a casing treatment is symmetrically configured with respect to a rotation axis of an impeller. Hereinafter, a casing treatment symmetrical with respect to the rotation axis is called a "symmetric casing treatment" and a casing treatment asymmetrical with respect to the rotation axis is called an "asymmetric casing treatment".

In the case of a centrifugal compressor including a symmetric casing treatment, a scroll channel of the casing is configured asymmetric with respect to a rotation axis of an impeller, and therefore the flow at the impeller outlet generates distortion in the circumferential direction due to the asymmetric scroll channel during a small flow rate outside a design range. Such distortion affects flow parameters on an upstream side, so that circumferential flow parameters of the impeller of the compressor or of the interior of a bladeless diffuser show asymmetric property.

Conventionally a symmetric casing treatment is configured without consideration given to an asymmetric property of a flow field at the interior of the compressor, and therefore the effect of extending a stable operating range from a casing treatment cannot be achieved for the entire circumferential direction. Accordingly in order to achieve an extending effect of an optimum stable operating range in the entire circumferential direction, an asymmetric self-recirculating casing treatment has to be used.

FIG. 1A is a half cross-sectional view of a centrifugal compressor including a self-recirculating casing treatment, and FIG. 1B is to explain the self-recirculating casing treatment.

In FIG. 1A, an impeller 13 includes an impeller full blade 11 and an impeller splitter blade 12. Z-Z represents the center of the rotation axis of the impeller 13. As illustrated in FIG. 1A and FIG. 1B, a self-recirculating casing treatment is typically configured including a suction ring groove 1, a ring guide channel 2 and a back-flow ring groove 3. The self-recirculating casing treatment has major configuration parameters of an axial direction distance (or axial distance) $S_r$ of the suction ring groove 1 with reference to an impeller full blade leading edge 4, a width $b_r$ of the suction ring groove, an axial distance $S_f$ of the back-flow ring groove 3 with reference to the impeller full blade leading edge 4, a width $b_f$ of the back-flow ring groove 3, a depth $h_b$ of the back-flow ring groove 3 and the width $b_b$ of the ring guide channel 2, for example.

It has been clarified by researches that the axial distance $S_r$ of the suction ring groove 1 with reference to the impeller full blade leading edge 4 and the width $b_r$ of the suction ring groove 1 directly determine a back-flow pressure difference and a back-flow rate, and such parameters greatly influence the expansion effect of an operating range. Therefore, correctly designed distribution of the axial distance $S_r$ of the suction ring groove in the circumferential direction or the width $b_r$ becomes a key to extend the operating range of the centrifugal compressor having an asymmetric self-recirculating casing treatment.

The present invention is invented to fulfill the aforementioned demands. That is, it is an object of the present invention to provide a centrifugal compressor including an asymmetric self-recirculating casing treatment having optimized circumferential distribution of an axial distance $S_r$ of a suction ring groove with reference to an impeller full blade leading edge and a width $b_r$, thereby enabling expansion of a stable operating range to a low-flow-rate side while keeping the efficiency.

A centrifugal compressor of the present invention includes an asymmetric self-recirculating casing treatment that includes, on an inner face of a casing, a suction ring groove (1), a ring guide channel (2) and a back-flow ring groove (3) to form a self-recirculating channel. A position or a width of the suction ring groove is distributed in an arc shape in a circumferential direction, and the arc has a center angle $\alpha$ in a range of $0<\alpha\leq 30°$.

In one embodiment of the present invention, the position may be an axial distance $S_r$ from an upstream end face of the suction ring groove to an impeller full blade leading edge (4), and a ratio between a radius R of the arc and an impeller diameter D may be in a range of $2\leq|R/D|\leq 40$.

In another embodiment of the present invention, the width may be a width $b_r$ of the suction ring groove, and a ratio between a radius R of the arc and an impeller diameter D may be in a range of $2\leq|R/D|\leq 20$.

The casing may include a shell (5) and a core (6), and the suction ring groove (1) may be provided on a wall face of the core (6), and an inner wall face of the shell and an outer wall face of the core may define the ring guide channel (2) and the back-flow ring groove (3).

Advantageous Effects of Invention

The below described examples show that, as compared with conventional techniques, the present invention using an asymmetric self-recirculating casing treatment including a suction ring groove having a position and a width distributed in an arc shape can extend a stable operating range of a centrifugal compressor greatly than that of a symmetric self-recirculating casing treatment, while substantially keeping the efficiency.

BRIEF DESCRIPTION OF DRAWINGS

FIG. 9B illustrates a relationship between a normalized mass flow rate and efficiency in Example 1.

DESCRIPTION OF EMBODIMENTS

Figure 1A:
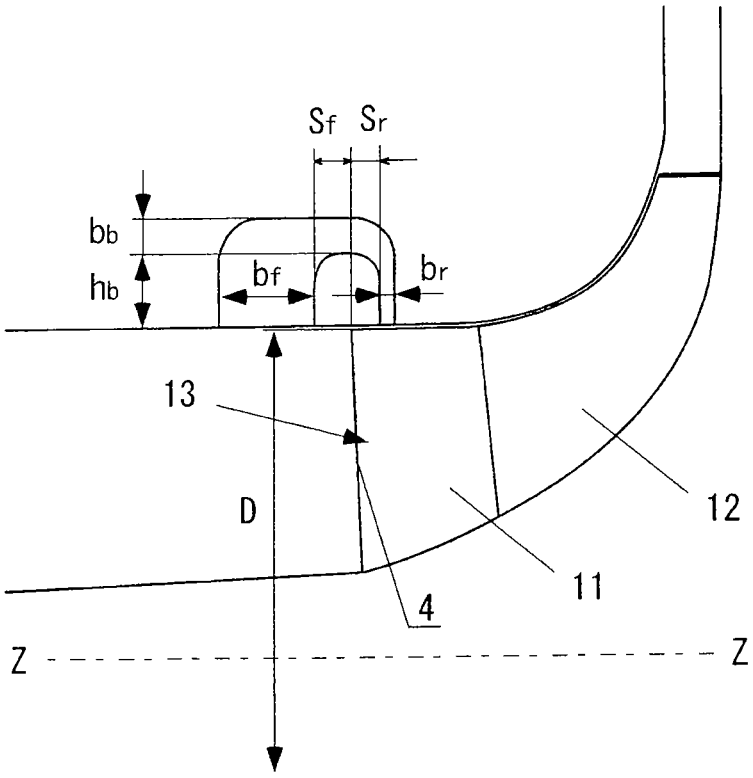
FIG. 1A is a half cross-sectional view of a centrifugal compressor including a self-recirculating casing treatment.

The following describes modes for carrying out the invention, with reference to the drawings. In the following, same reference numerals will be assigned to common elements in the drawings to omit their duplicated descriptions.

Embodiment 1

Figure 2A:
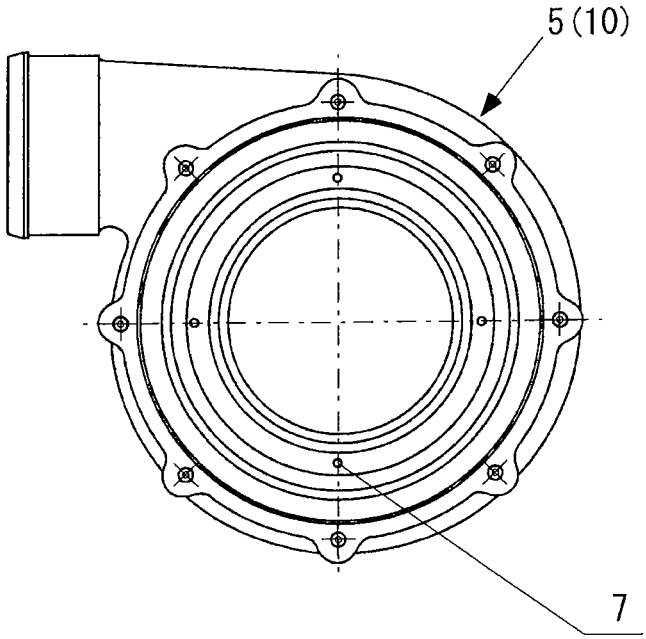
FIG. 2A is a schematic front view of a shell of a casing.
Figure 2B:
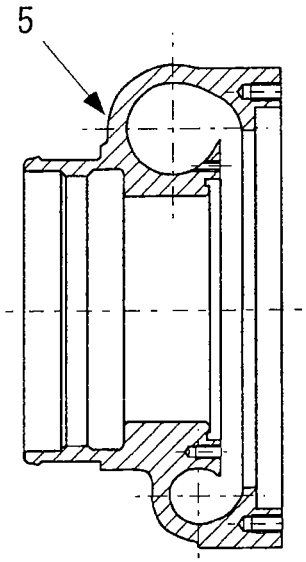
FIG. 2B is a schematic cross-sectional view of the shell of the casing.
Figure 3:
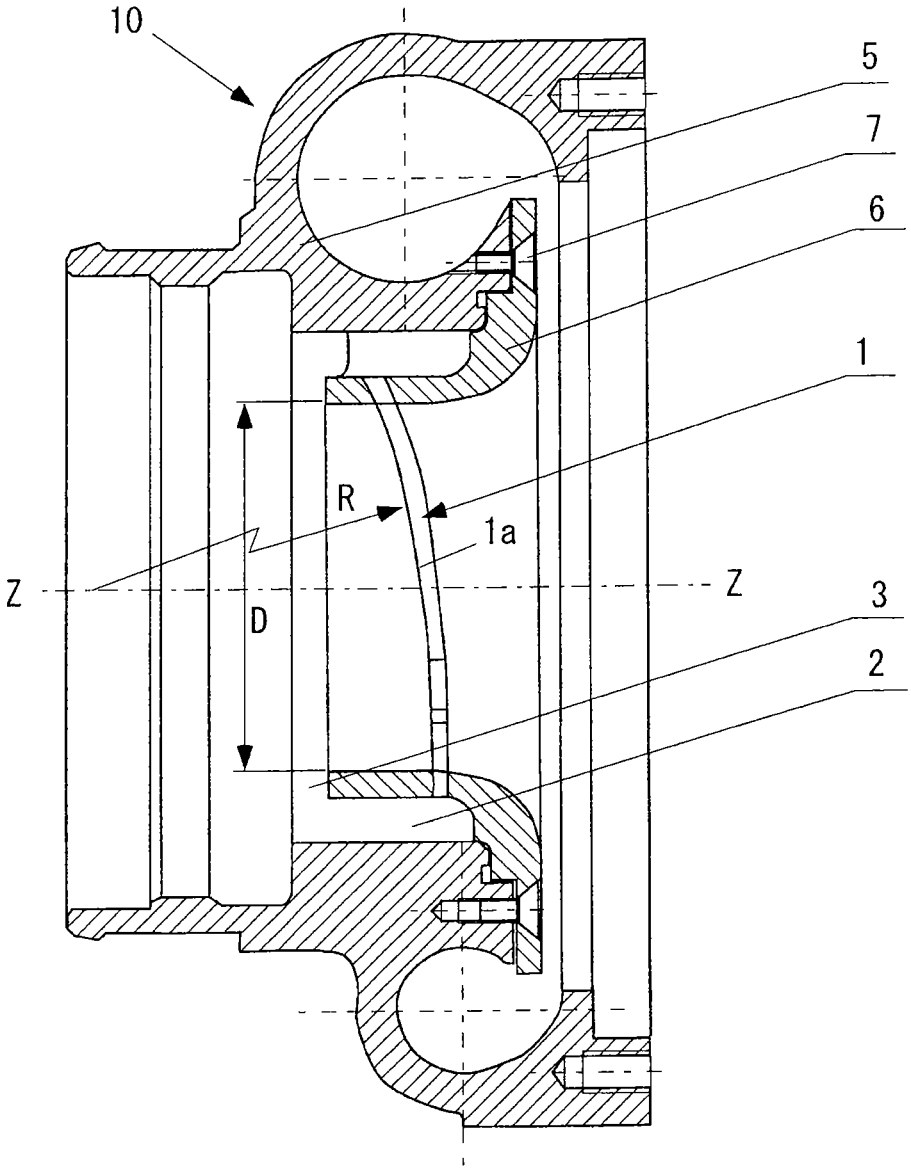
FIG. 3 is a schematic view of the casing of the compressor.
Figure 4:
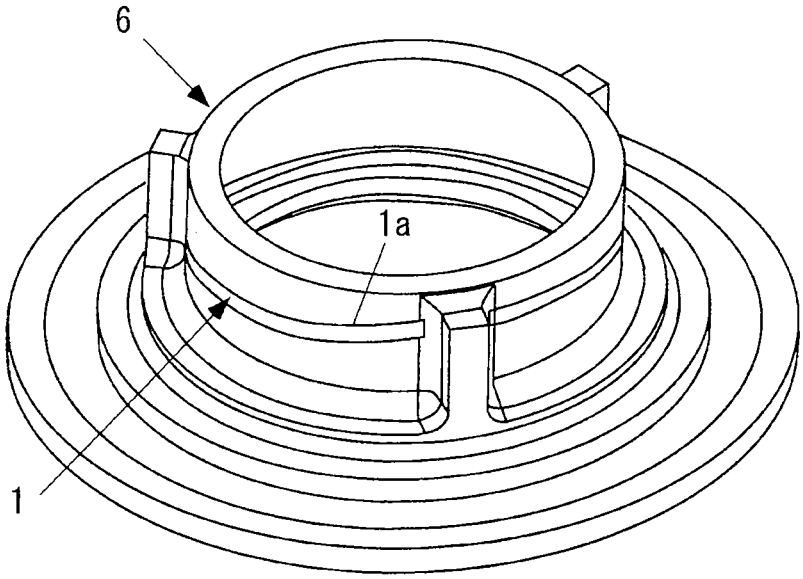
FIG. 4 is a schematic view of the configuration of a core of the casing.
Figure 5:
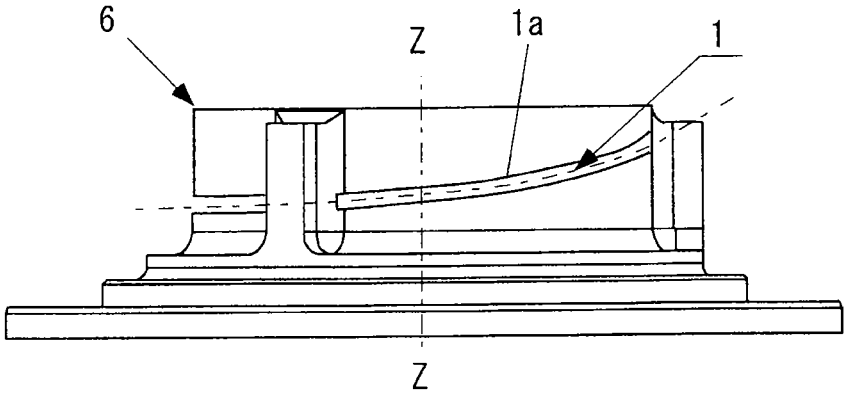
FIG. 5 is a schematic view of a suction ring groove in the core.

FIG. 2A, FIG. 2B and FIGS. 3 to 5 schematically illustrate Embodiment 1 of the present invention. FIG. 2A is a schematic front view of a shell 5 of a casing, FIG. 2B is a schematic half cross-sectional view thereof, FIG. 3 is a schematic view of the casing, FIG. 4 is a schematic view of the configuration of a core 6 of the casing, and FIG. 5 is a schematic view of a suction ring groove in the core.

Figure 1B:
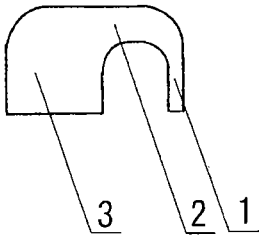
FIG. 1B is to explain the self-recirculating casing treatment.

As illustrated in FIG. 1, the centrifugal compressor of the present invention includes an asymmetric self-recirculating casing treatment that includes, on an inner face of a casing, a suction ring groove 1, a ring guide channel 2 and a back-flow ring groove 3, thus forming a self-recirculating channel.

The self-recirculating channel means a back-flow channel including the suction ring groove 1, the ring guide channel 2 and the back-flow ring groove 3 so as to return the fluid from a position downstream of an impeller full-blade leading edge to a position upstream of the impeller full-blade leading edge.

In the centrifugal compressor of Embodiment 1, as illustrated in FIG. 3, a casing 10 includes the shell 5 and the core 6, where the suction ring groove 1 is provided on a wall face of the core 6, and the inner wall face of the shell 5 and the outer wall face of the core 6 define the ring guide channel 2 and the back-flow ring groove 3.

In the asymmetric self-recirculating casing treatment of Embodiment 1, the position of the suction ring groove 1, i.e., the axial distance $S_r$ from an upstream end face 1*a* of the suction ring groove 1 to the impeller full blade leading edge 4 is distributed in an arc (or semicircular) shape in the circumferential direction.

As illustrated in FIG. 3, in Embodiment 1, the arc of the axial distance $S_r$ has a center angle $\alpha$ (not illustrated) in the range of $0<\alpha\leq 30°$, and the ratio between the radius R of the arc and the impeller diameter D is in the range of $2\leq|R/D|\leq 40$.

The position of the suction ring groove 1 following the arc-shaped distribution as designed defines a curve on a circumferential cylindrical column face of the core 6, which is illustrated with alternate long and short dash lines in FIG. 5.

In FIG. 2A, FIG. 2B and FIG. 3, the shell 5 of the casing is fixed, and the core 6 is rotated around the rotation axis center Z-Z of the impeller 13 (see FIG. 1) so as to change the opposed position of these members during assembly, whereby the arc-shaped distribution of the positions (axial distance $S_r$) of the suction ring groove 1 corresponding to different initial phase angles $\theta_0$ can be obtained.

That is, the shell 5 and the core 6 of the casing 10 are jointed by screws 7. At the shell 5 of the casing 10 are uniformly disposed n pieces (in this example, four) of screw holes in the circumferential direction, so that the distribution curves of the axial distance $S_r$ corresponding to different n pieces of initial phase angles $\theta_0$ are obtained. Performance test of the compressor is performed, whereby an optimum initial phase angle $\theta_0$ may be decided from the different n pieces of initial phase angles $\theta_0$.

Figure 6:
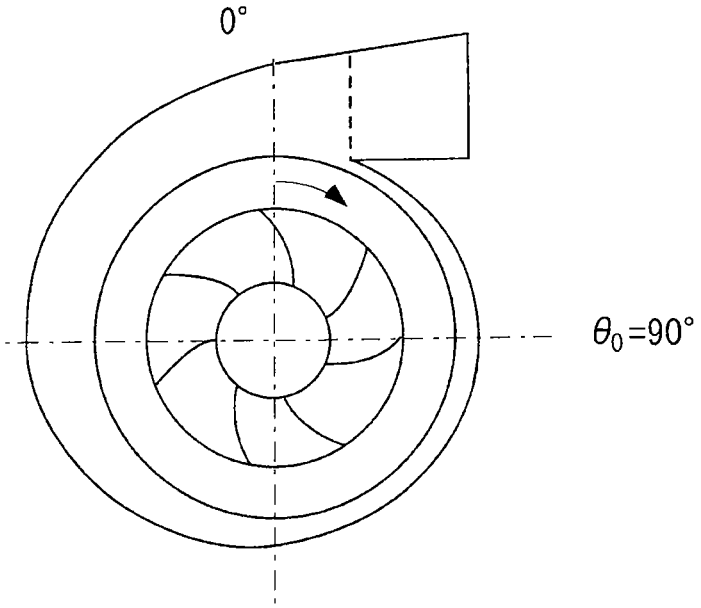
FIG. 6 schematically illustrates a position of an initial phase angle $\theta_0$ in one example.
Figure 7:
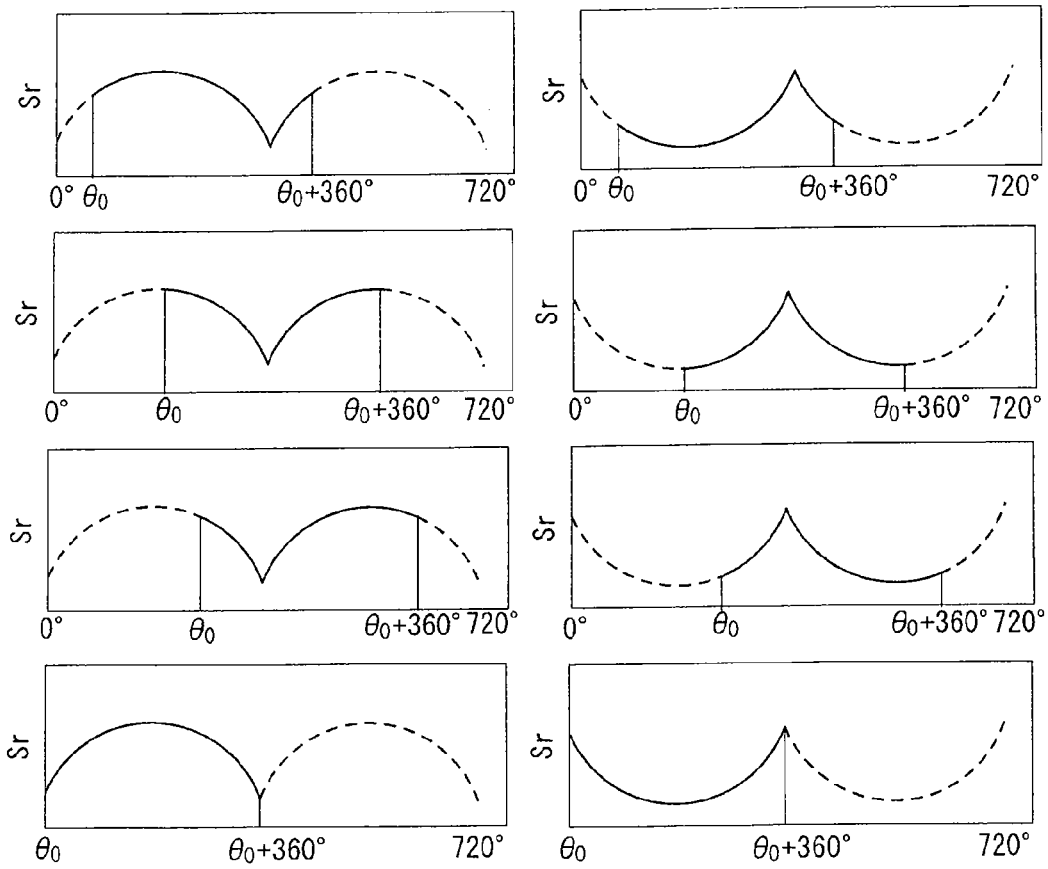
FIG. 7 schematically illustrates the distribution of the axial distances $S_r$ of the suction ring groove corresponding to different initial phase angles $\theta_0$.

FIG. 6 schematically illustrates a position of an initial phase angle $\theta_0$ in one example. FIG. 7 schematically illustrates the distribution of $S_r$ values of the suction ring groove corresponding to different initial phase angles $\theta_0$.

In FIG. 2A and FIG. 2B, since four screw holes in total are provided at the shell 5 of the casing 10, different four types of arc-shape distributions of the axial distance $S_r$ of the suction ring groove 1 are obtained as illustrated in FIG. 7.

FIG. 7 schematically illustrates the distribution of the axial distances $S_r$ of the suction ring groove 1 corresponding to different initial phase angles $\theta_0$.

In FIG. 7, solid lines represent an arc-shape distribution of the axial distance $S_r$ of the suction ring groove 1 in the circumferential direction, which can be represented variously by differently selecting the initial phase angle $\theta_0$ in the circumferential direction. Among them, $\theta_0$ represents an initial phase angle, and the casing 10 is the full circle of $0° \leq \theta_0 \leq 360°$. In the drawing, $\theta_0$ to $\theta_0+360°$ is the full circle angle of the casing 10.

In the operation of the centrifugal compressor of the present invention, at a low flow-rate mode, the gas in the channel of the self-recirculating casing treatment flows into through the suction ring groove 1 and flows outside via the ring guide channel 2 and the back-flow ring groove 3.

More specifically, the centrifugal compressor operates based on the principle that the suction ring groove 1 of the self-recirculating casing treatment sucks the gas at an impeller blade tip area, and the gas flows through the ring guide channel 2 and the back-flow ring groove 3 discharges the gas.

As the back-flow ring groove 3 discharges the gas, (1) the gas suction effect of the impeller blade tip area at the axial distance $S_r$ of the suction ring groove 1 causes leakage vortex at a clearance of the impeller blade tip to be sucked to the suction ring groove 1, thus interrupting a leakage flowing channel, (2) a back-flow is discharged to the compressor inlet, and the communication of the flow in the back-flow ring groove 3 realizes the uniform flow at the compressor inlet and removes shock waves in the channel, and (3) while the back-flow increases the inlet flow rate and decreases a positive angle of attack at the impeller blade inlet, the suction effect by the suction ring groove 1 decreases the back pressure of the compressor outlet and decreases the adverse pressure gradient, thus effectively suppressing the separation of boundary layers on the impeller blade surface.

For a better back-flow effect at a corresponding position in the circumferential direction, the groove position (axial distance $S_r$) of the suction ring groove 1 is distributed in an arc shape in the circumferential direction, whereby the effect of the back-flow can be more effectively used to extend a stable operating range of the compressor.

At an operational mode close to a blockage, the gas in the channel of the self-recirculating casing treatment flows through the back-flow ring groove 3 and the ring guide channel 2 and is discharged from the suction ring groove 1. The back-flow ring groove 3 enables communication of the flow at the inlet in the circumferential direction to increase the uniformity of the flow at the compressor inlet and weaken shock waves at the inlet, and the discharged flow of the suction ring groove 1 strengthens the circulation ability, thus extending blockage boundary. However, because of the shortage of suction power at an operational mode close to a blockage, expansion for the blockage boundary of the casing treatment is not so remarkable as the expansion for stall boundary.

Example 1

The following describes an example to extend a stable operation range by using an asymmetric self-recirculating casing treatment for a centrifugal compressor having a groove position in an arc-shaped distribution in a centrifugal compressor of a certain size.

Figure 8:
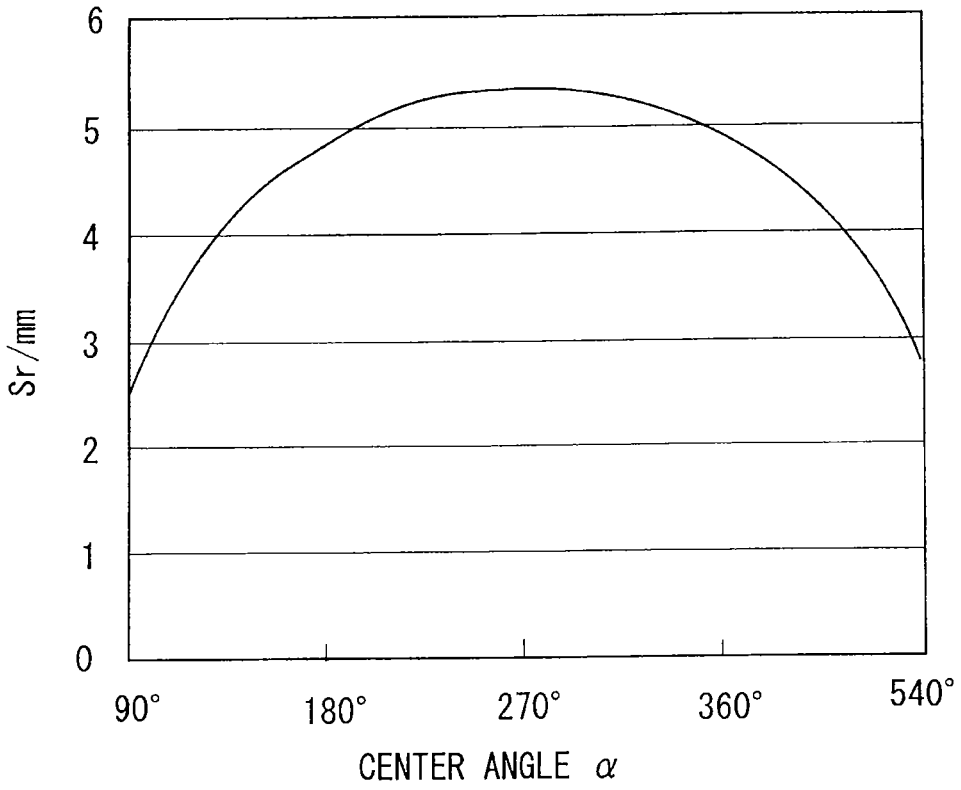
FIG. 8 schematically illustrates the distribution of the axial distances $S_r$ in Example 1.

FIG. 8 schematically illustrates the distribution of $S_r$ values in the example.

The $S_r$ values of the asymmetric casing treatment of the centrifugal compressor are shown as in FIG. 8. The initial phase angle $\theta_0$ is at the position of $\theta_0=90°$ in FIG. 6.

Figure 9A:
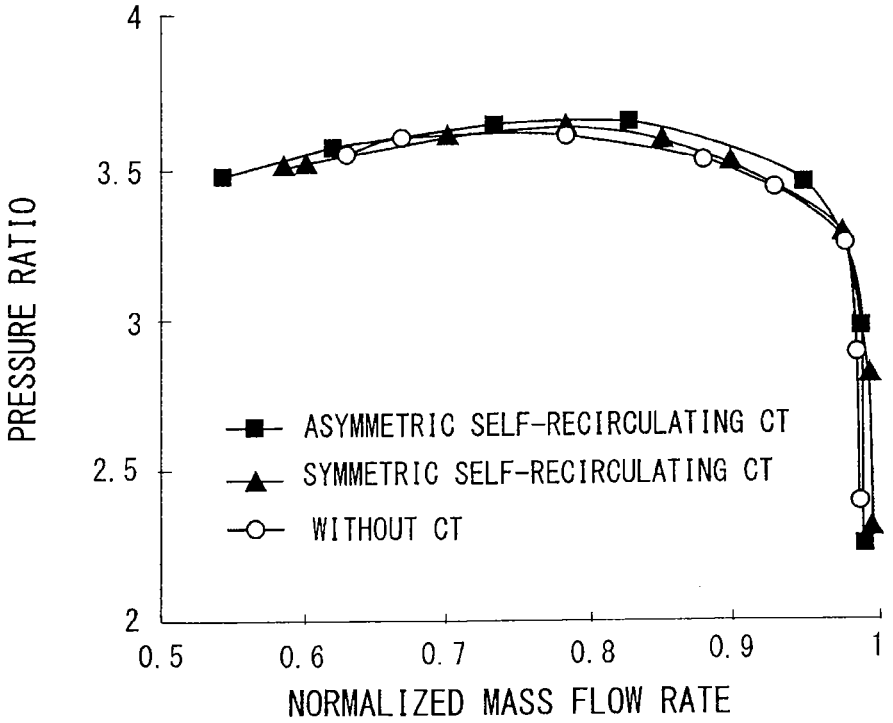
FIG. 9A illustrates a relationship between a normalized mass flow rate and a pressure ratio in Example 1.
Figure 9A:
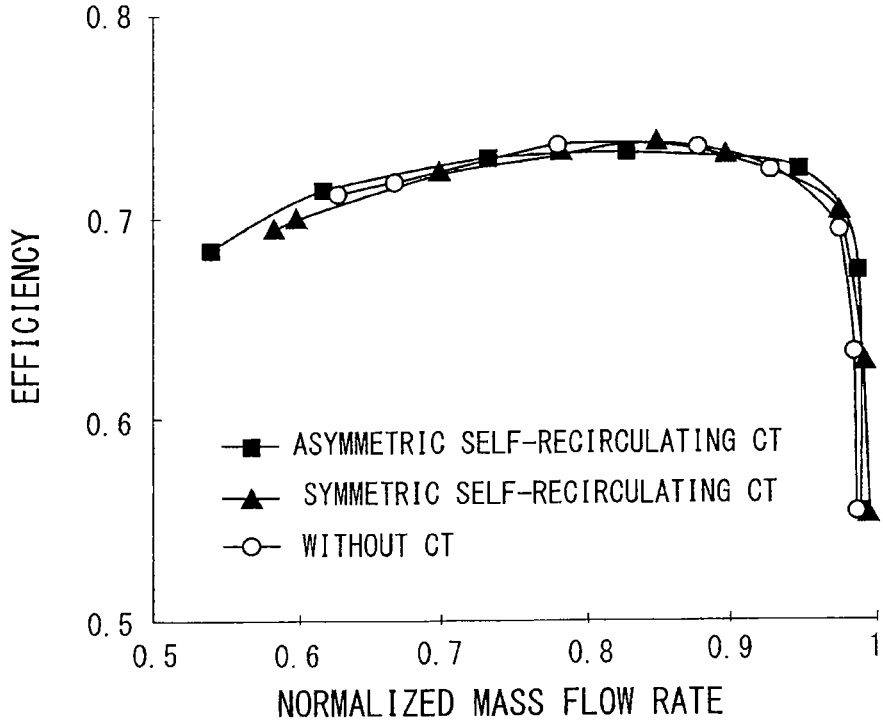

FIG. 9A illustrates a relationship between a normalized mass flow rate and a pressure ratio in Example 1. FIG. 9B illustrates a relationship between a normalized mass flow rate and efficiency in Example 1.

FIG. 9A and FIG. 9B illustrate a comparison of compressor performance among an asymmetric self-recirculating casing treatment having a groove position in an arc-shaped distribution ("asymmetric self-recirculating CT"), a symmetric self-recirculating casing treatment ("symmetric self-recirculating CT") and without casing treatment ("without CT").

The performance comparison between FIG. 9A and FIG. 9B shows that the asymmetric self-recirculating casing treatment having a groove position in an arc-shaped distribution ("asymmetric self-recirculating CT") of the present invention can extend a stable operating range of the compressor to a low flow-rate side while basically keeping the efficiency as compared with the case of without a casing treatment ("without CT") and the symmetric self-recirculating casing treatment ("symmetric self-recirculating CT").

Embodiment 2

Figure 10:
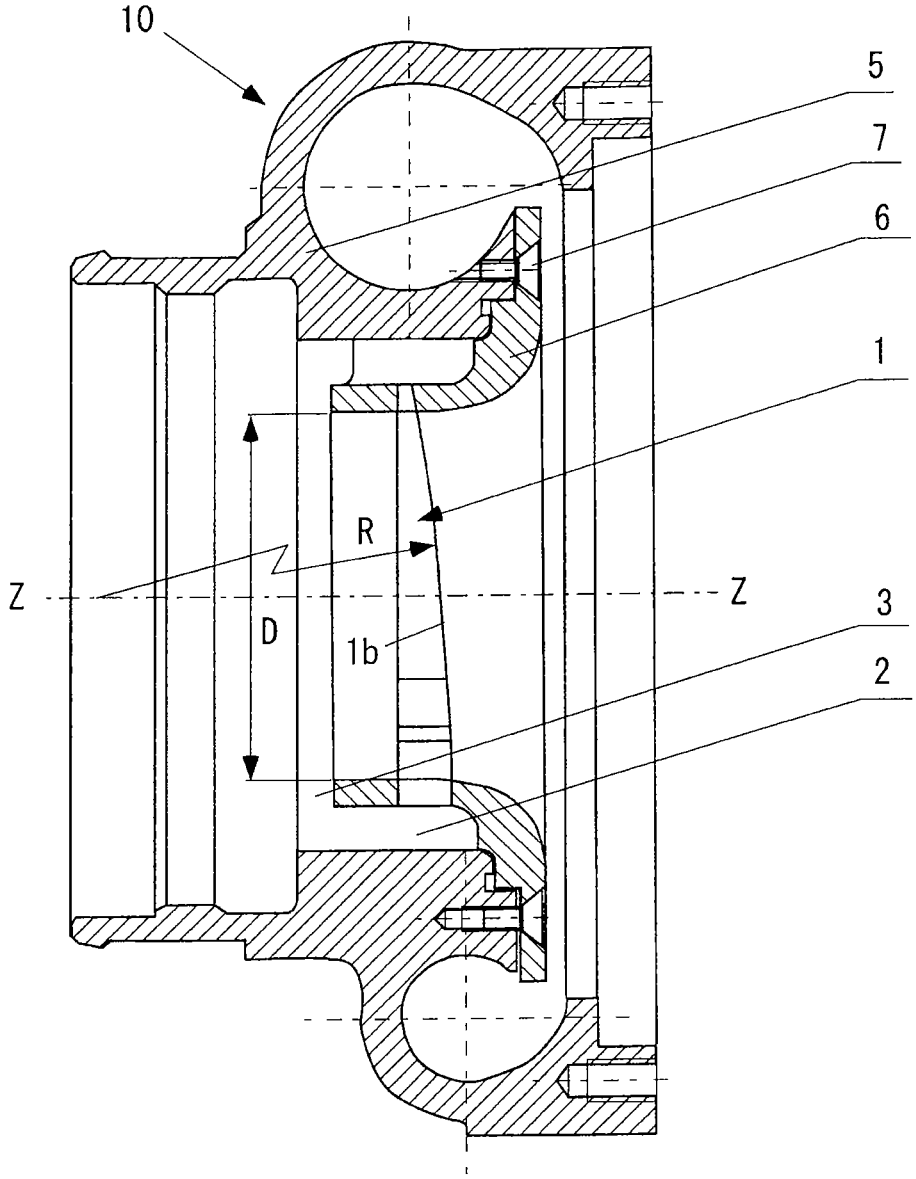
FIG. 10 is a schematic view of a casing of a compressor.
Figure 11:
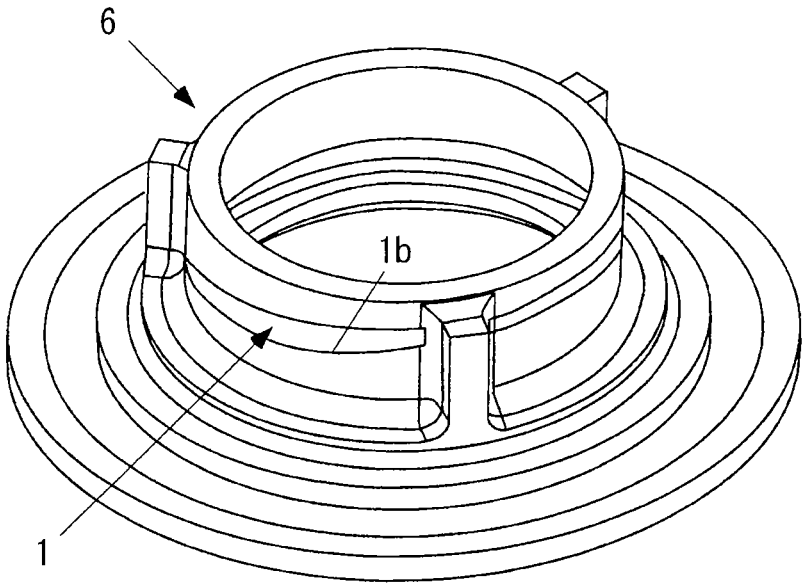
FIG. 11 is a schematic view of the configuration of a core of the casing.
Figure 12:
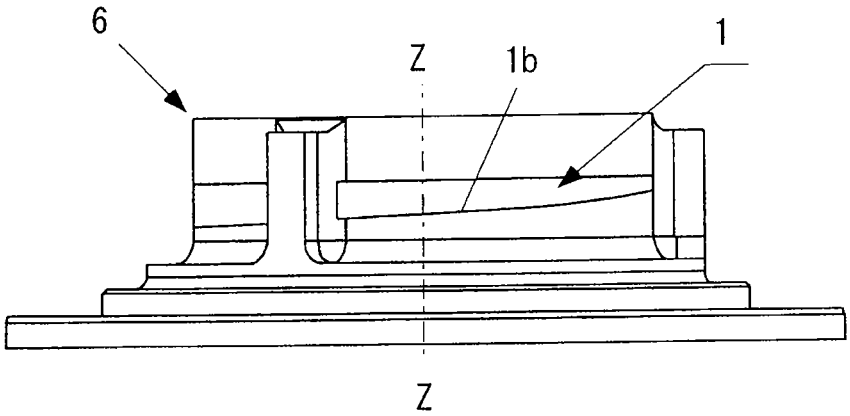
FIG. 12 is a schematic view of a suction ring groove in the core.

FIG. 10 to FIG. 12 schematically illustrate Embodiment 2 of the present invention, where FIG. 10 is a schematic view of a casing 10 of a compressor, FIG. 11 is a schematic view of the configuration of a core 6 of the casing 10, and FIG. 12 is a schematic view of a suction ring groove 1 in the core 6.

FIG. 2A and FIG. 2B are common to Embodiment 1.

As illustrated in FIG. 1, the centrifugal compressor of the present invention includes an asymmetric self-recirculating casing treatment that includes, on an inner face of a casing, a suction ring groove 1, a ring guide channel 2 and a back-flow ring groove 3, thus forming a self-recirculating channel.

In the centrifugal compressor of Embodiment 2, as illustrated in FIG. 10, a casing 10 includes a shell 5 and the core 6, where the suction ring groove 1 is provided on a wall face of the core 6, and the inner wall face of the shell 5 and the outer wall face of the core 6 define the ring guide channel 2 and the back-flow ring groove 3.

In the asymmetric self-recirculating casing treatment of Embodiment 2, the width $b_r$ of the suction ring groove 1 is distributed in an arc shape in the circumferential direction.

Further as illustrated in FIG. 10, in Embodiment 2, the arc of the width $b_r$ of the suction ring groove 1 has a center angle $\alpha$ (not illustrated) in the range of $0<\alpha\leq30°$, and the ratio between the radius R of the arc and the impeller diameter D is in the range of $2\leq|R/D|\leq20$.

In FIG. 12, a downstream end 1*b* of the suction ring groove 1 following the arc-shaped distribution as designed defines a curve on a circumferential cylindrical column face of the core 6.

In FIG. 2A, FIG. 2B, FIG. 10 and FIG. 11, the shell 5 of the casing 10 is fixed, and the core 6 is rotated around the rotation axis center Z-Z of the impeller 13 (see FIG. 1) so as to change the opposed position of these members during assembly, whereby the arc-shaped distribution of the width $b_r$ of the suction ring groove 1 corresponding to different initial phase angles $\theta_0$ can be obtained.

That is, the shell 5 and the core 6 of the casing are jointed by screws 7. At the shell 5 of the casing 10 are uniformly disposed n pieces (in this example, four) of screw holes in the circumferential direction, so that the distribution curves corresponding to different n pieces of initial phase angles $\theta_0$ are obtained. Performance test of the compressor is performed, whereby an optimum initial phase angle $\theta_0$ may be decided.

FIG. 6, referred to common to Embodiment 1, schematically illustrates a position of an initial phase angle $\theta_0$ in one example.

Figure 13:
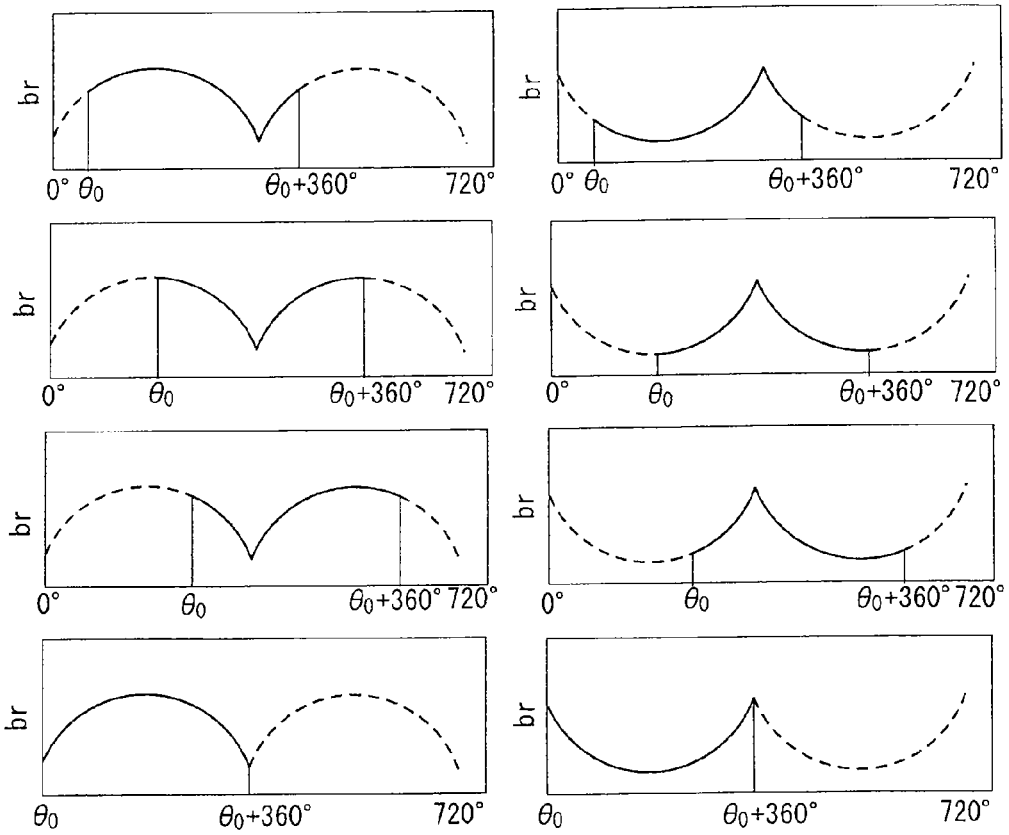
FIG. 13 schematically illustrates the distribution of the widths $b_r$ of the suction ring groove corresponding to different initial phase angles $\theta_0$.

For instance, since the four screw holes in total are provided at the shell 5 of the casing 10 in FIG. 2A and FIG. 2B, different four types of arc-shape distributions of the width $b_r$ of the suction ring groove 1 are obtained as illustrated in FIG. 13.

FIG. 13 schematically illustrates the distribution of the widths $b_r$ of the suction ring groove 1 corresponding to different initial phase angles $\theta_0$.

In FIG. 13, solid lines represent an arc-shape distribution of the widths $b_r$ of the suction ring groove 1 in the circumferential direction, which can be represented variously by differently selecting the initial phase angle $\theta_0$ in the circumferential direction. Among them, $\theta_0$ represents an initial phase angle, and the casing 10 is the full circle of $0° \leq \theta_0 \leq 360°$. In the drawing, $\theta_0$ to $\theta_0+360°$ is the full circle angle of the casing.

In the operation of the centrifugal compressor of the present invention, at a low flow-rate mode, the gas in the channel of the self-recirculating casing treatment flows into through the suction ring groove 1 and flows outside via the ring guide channel 2 and the back-flow ring groove 3.

More specifically, the centrifugal compressor operates based on the principle that the suction ring groove 1 of the self-recirculating casing treatment sucks the gas at an impeller blade tip area, and the gas flows through the ring guide channel 2 and the back-flow ring groove 3 discharges the gas.

As the back-flow ring groove 3 discharges the gas, (1) the gas suction effect of the impeller blade tip area at the groove width $b_r$ of the suction ring groove 1 causes leakage vortex at a clearance of the impeller blade tip to be sucked to the suction ring groove 1, thus interrupting a leakage flowing channel, (2) a back-flow is discharged to the compressor inlet, and the communication of the flow in the back-flow ring groove 3 realizes the uniform flow at the compressor inlet and removes shock waves in the channel, and (3) while the back-flow increases the inlet flow rate and decreases a positive angle of attack at the impeller blade inlet, the suction effect by the suction ring groove 1 decreases the back pressure of the compressor outlet and decreases the adverse pressure gradient, thus effectively suppressing the separation of boundary layers on the impeller blade surface.

For a better back-flow effect at a corresponding groove width in the circumferential direction, the groove width $b_r$ of the suction ring groove 1 is distributed in an arc shape in the circumferential direction, whereby the effect of the back-flow can be more effectively used to extend a stable operating range of the compressor.

At an operational mode close to a blockage, the gas in the channel of the self-recirculating casing treatment flows through the back-flow ring groove 3 and the ring guide channel 2 and is discharged from the suction ring groove 1. The back-flow ring groove 3 enables communication of the flow at the inlet in the circumferential direction to increase the uniformity of the flow at the compressor inlet and weaken shock waves at the inlet, and the discharged flow of the suction ring groove 1 strengthens the circulation ability, thus extending blockage boundary. However, because of the shortage of suction power at an operational mode close to a blockage, expansion for the blockage boundary of the casing treatment is not so remarkable as the expansion for stall boundary.

Example 2

The following describes an example to extend a stable operation range by using an asymmetric self-recirculating casing treatment for a centrifugal compressor having a width $b_r$ of the suction ring groove 1 in an arc-shaped distribution in a centrifugal compressor of a certain size.

Figure 14:
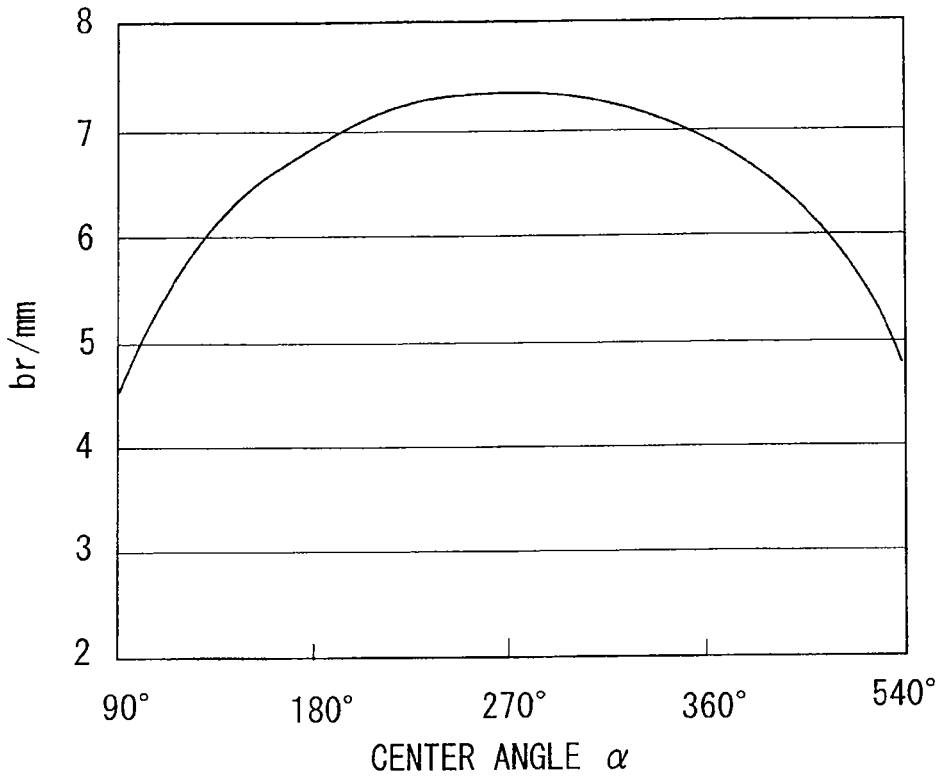
FIG. 14 schematically illustrates the distribution of the widths $b_r$ in Example 2.

FIG. 14 schematically illustrates the distribution of the widths $b_r$ of the suction ring groove 1 in Example 2.

The distribution of the widths $b_r$ of the asymmetric casing treatment of the centrifugal compressor is shown as in FIG. 14. The initial phase angle $\theta_0$ is at the position of $\theta_0=90°$ in FIG. 6.

Figure 15A:
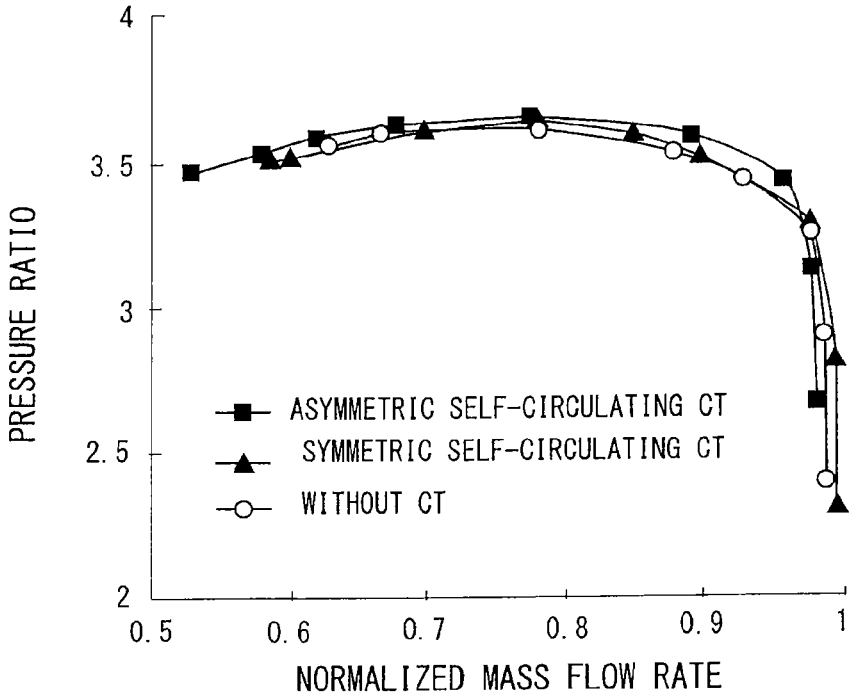
FIG. 15A illustrates a relationship between a normalized mass flow rate and a pressure ratio in Example 2.
Figure 15B:
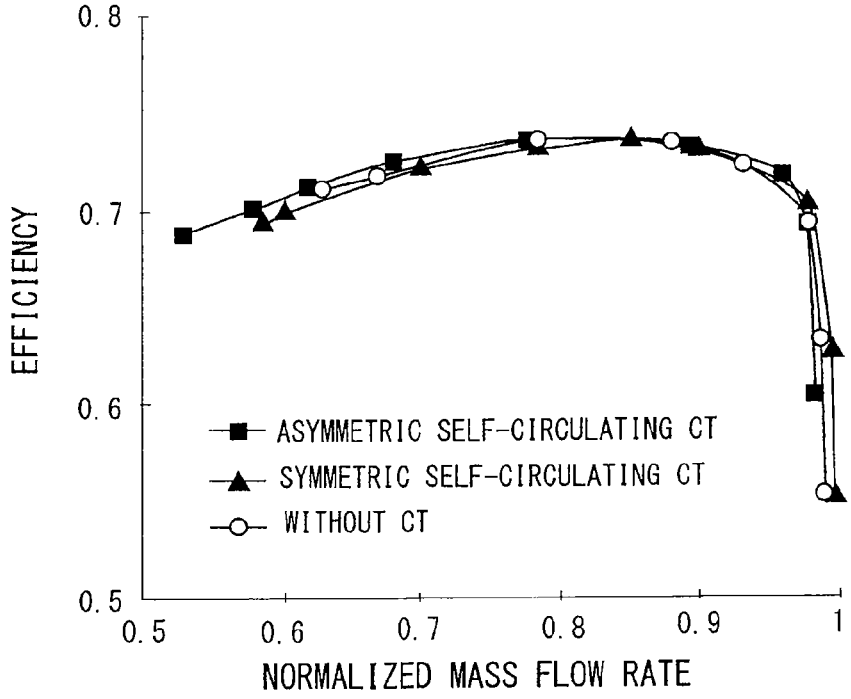
FIG. 15B illustrates a relationship between a normalized mass flow rate and efficiency in Example 2.

FIG. 15A illustrates a relationship between a normalized mass flow rate and a pressure ratio in Example 2. FIG. 15B illustrates a relationship between a normalized mass flow rate and efficiency in Example 2.

FIG. 15A and FIG. 15B illustrate a comparison of compressor performance among an asymmetric self-recirculating casing treatment having a groove width in an arc-shaped distribution ("asymmetric self-recirculating CT"), a symmetric self-recirculating casing treatment ("symmetric self-recirculating CT") and without casing treatment ("without CT").

The performance comparison between FIG. 15A and FIG. 15B shows that the asymmetric self-recirculating casing treatment having a groove width in an arc-shaped distribution ("asymmetric self-recirculating CT") of the present invention can extend a stable operating range of the compressor to a low flow-rate side while basically keeping the efficiency as compared with the case of without a casing treatment ("without CT") and the symmetric self-recirculating casing treatment ("symmetric self-recirculating CT").

As described above, Examples 1 and 2 show that as compared with conventional techniques, the present invention uses an asymmetric self-recirculating casing treatment having a position of the suction ring groove 1 (axial distance $S_r$) or a width (width $b_r$) thereof in an arc-shaped distribution, thereby enabling great expansion of a stable operating range of the centrifugal compressor while basically keeping the efficiency as compared with a symmetric self-recirculating casing treatment.

The present invention is not limited to the aforementioned embodiments, and can be modified variously in the range without departing from the scope of the present invention.

DESCRIPTION OF REFERENCE NUMERALS

1: suction ring groove
1*a*: upstream end face, 1*b*: downstream end face
2: ring guide channel
3: back-flow ring groove, 4: impeller full blade leading edge
5: shell, 6: core, 7: screw
10: casing, 11: impeller full blade
12: impeller splitter blade, 13: impeller

The invention claimed is:

1. A centrifugal compressor comprising: an asymmetric self-recirculating casing treatment that includes, on an inner face of a casing, a suction ring groove, a ring guide channel and a back-flow ring groove to form a self-recirculating channel, wherein the self-recirculating casing treatment has a plurality of parameters, including a axial distance $S_r$ that is the distance form an upstream end face of the suction ring groove to an impeller full blade leading edge, with a width $b_r$ of the suction ring groove, wherein a position of the suction ring groove is shiftable in a circumferential direction, wherein, as the position of the suction ring groove shifts in the circumferential direction, either the axial distance $S_r$ or the width $b_r$ gradually increases over a first circumferential range, and then gradually decreases over a second circumferential range, wherein the first circumferential range and the second circumferential range each continuously extend in the circumferential direction, and the first circumferential range and the second circumferential range form one complete circling range, wherein a shape of change in the axial distance $S_r$ or the width $b_r$ with respect to circumferential shifting of the position of the suction ring groove is an arc shape, and wherein the arc has a center angle $\alpha$ in a range of $0<\alpha\leq 30°$.

2. The centrifugal compressor according to claim 1, wherein a ratio between a radius R of the arc for the axial distance $S_r$ and an impeller diameter D is in a range of $2\leq|R/D|\leq 40$.

3. The centrifugal compressor according to claim 1, wherein a ratio between a radius R of the arc for the width $b_r$ and an impeller diameter D is in a range of $2\leq|R/\beta\leq 20$.

4. The centrifugal compressor according to claim 1, wherein the casing includes a shell and a core, and the suction ring groove is provided on a wall face of the core, and an inner wall face of the shell and an outer wall face of the core define the ring guide channel and the back-flow ring groove.

5. The centrifugal compressor according to claim 2, wherein the casing includes a shell and a core, and the suction ring groove is provided on a wall face of the core, and an inner wall face of the shell and an outer wall face of the core define the ring guide channel and the back-flow ring groove.

6. The centrifugal compressor according to claim 3, wherein the casing includes a shell and a core, and the suction ring groove is provided on a wall face of the core, and an inner wall face of the shell and an outer wall face of the core define the ring guide channel and the back-flow ring groove.

* * * * *